US007578752B1

(12) United States Patent
Flores

(10) Patent No.: US 7,578,752 B1
(45) Date of Patent: Aug. 25, 2009

(54) PUTTER TRAINING DEVICE

(76) Inventor: Flavio Flores, 858 Sanford Ave., Chula Vista, CA (US) 91913

( * ) Notice: Subject to any disclaimer, the term of this patent is extended or adjusted under 35 U.S.C. 154(b) by 0 days.

(21) Appl. No.: 12/366,199

(22) Filed: Feb. 5, 2009

(51) Int. Cl.
*A63B 69/36* (2006.01)
*A63B 53/04* (2006.01)

(52) U.S. Cl. ..... 473/330; 473/251; 473/340

(58) Field of Classification Search ..... 473/219, 473/249, 266, 251, 252, 253, 254, 324, 325, 473/330, 340, 341, 345, 346, 350
See application file for complete search history.

(56) References Cited

U.S. PATENT DOCUMENTS

| | | | | |
|---|---|---|---|---|
| 2,003,951 | A | 6/1935 | Pepin | |
| 3,019,022 | A | 1/1962 | Ehmke | |
| 3,333,854 | A | 8/1967 | White | |
| D240,445 | S | 7/1976 | Becker | |
| 4,010,958 | A * | 3/1977 | Long | 473/341 |
| 4,032,156 | A | 6/1977 | Clarke | |
| 4,136,877 | A | 1/1979 | Antonious | |
| 4,209,172 | A | 6/1980 | Yamamoto | |
| 4,458,900 | A | 7/1984 | Antonious | |
| 4,928,971 | A | 5/1990 | Soles, Jr. | |
| 4,960,279 | A | 10/1990 | Harris | |
| 5,941,782 | A * | 8/1999 | Cook | 473/346 |
| 6,716,110 | B1 * | 4/2004 | Ballow | 473/242 |
| 7,048,646 | B2 * | 5/2006 | Yamanaka et al. | 473/332 |
| 7,074,136 | B2 * | 7/2006 | Noguchi et al. | 473/346 |
| 7,101,288 | B2 | 9/2006 | Thomas | |
| 7,226,362 | B1 | 6/2007 | Schell et al. | |
| 7,384,345 | B2 | 6/2008 | Sherman | |

* cited by examiner

*Primary Examiner*—Nini Legesse
(74) *Attorney, Agent, or Firm*—Frank G. Morkunas

(57) ABSTRACT

A putter training device having an outer perimeter wall with two vertical bars within. The two vertical bars bisect each other at their respective centers. Each vertical bar has a centerline transversing it full length. The centerlines form references lines for a golfer when practicing the art of putting. The centerlines may be colored flat line marking with the color being easily seen or the centerlines may be grooves cut into the tops of each vertical bar. Indicia representing the width of a conventional golf ball are on top of the outer perimeter wall at a point where the device is designed to strike the golf ball. The diameter of the outer perimeter is of a width substantially equal to the diameter of a conventional golf hole.

7 Claims, 1 Drawing Sheet

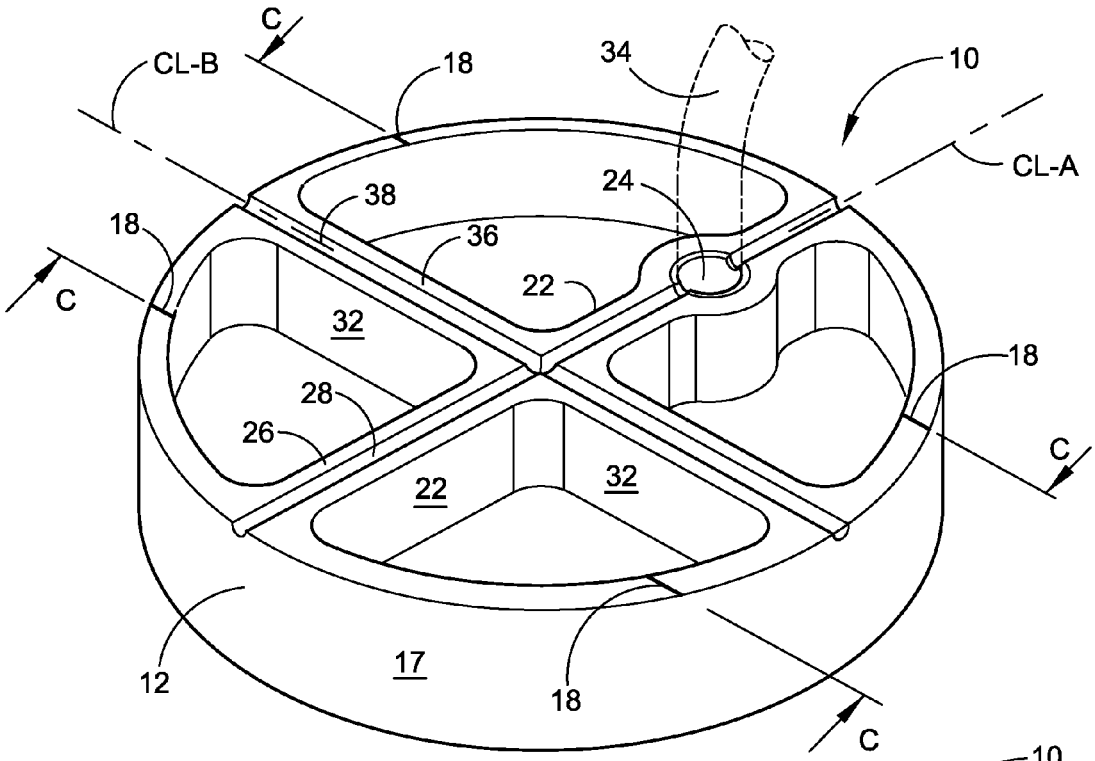
Fig. 1
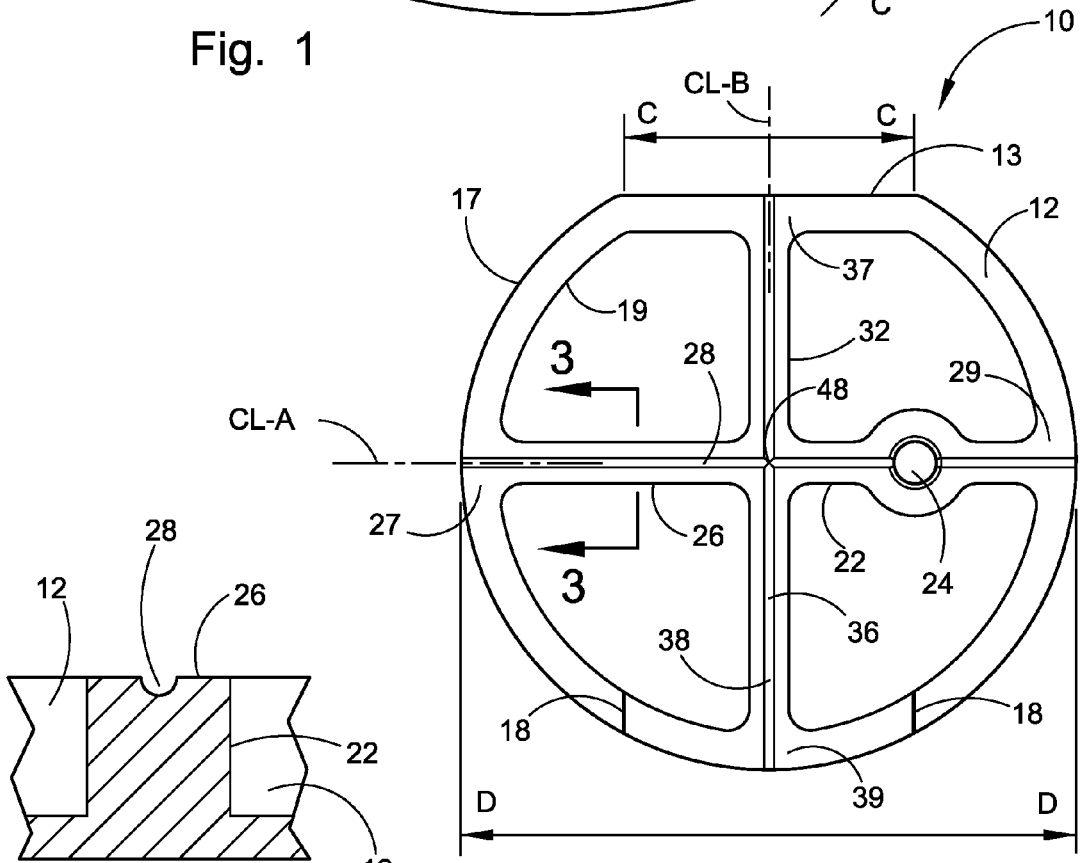
Fig. 2
Fig. 3

PUTTER TRAINING DEVICE

CROSS REFERENCES TO RELATED APPLICATIONS

None.

STATEMENT REGARDING FEDERALLY-SPONSORED RESEARCH OR DEVELOPMENT

Not applicable.

BACKGROUND

This novel device relates to an improvement in golfing, and more particularly to training in and improving one's short game; i.e., putting. There are many training devices in the marketplace which aid a golfer in the golfer's putting game. None of these devices, however, can provide immediate feedback to a golfer's stroke as to whether the golfer is "pushing" or "pulling" in the execution of the stroke to the minutest of detail and directness of "strike" on the ball. The rounded ring with perpendicularly crossed vertical bars therebetween, each having a centerline [or reference line] which form the basis for the golfer's position of strike to the ball at as close to dead-center on the ball and relation of the putter shaft to the golfer.

Training with this device will improve ball position, shoulder and feet alignment, and promote smoother and more consistent strokes where it counts; on the green. The reference lines will aid the golfer in properly addressing the ball with the golfer's eyes, shoulders, and feet parallel to the target [the golf hole] and to the associated reference line [i.e., parallel to centerline indicia-B (CL-B) of the drawing figures and perpendicular to centerline indicia-A (CL-A)]. When the ball is struck, the golfer will experience the full fluid feel of the strike and in the process receive immediate, real-time, feedback as to the accuracy of the stroke.

The foregoing has outlined some of the more pertinent objects of the improved putter training device. These objects should be construed to be merely illustrative of some of the more prominent features and applications of the improved putter training device. Many other beneficial results can be attained by applying the disclosed improved putter training device in a different manner or by modifying the improved putter training device within the scope of the disclosure. Accordingly, other objects and a fuller understanding of the improved putter training device may be had by referring to the summary of the improved putter training device and the detailed description of the preferred embodiment in addition to the scope of the improved putter training device defined by the claims taken in conjunction with the accompanying drawings.

SUMMARY

The above-noted problems, among others, are overcome by the improved putter training device. Briefly stated, the improved putter training device contemplates a putter training device which an outer perimeter wall and two vertical bars within. Each bar has a centerline transversing its full length. The two vertical bars bisect each other at their respective centers to define an exact center of the device. Indicia representing the width of a conventional golf ball are on top of the outer perimeter wall at the ball striking point; a point where the device is designed to strike the golf ball.

In its preferred embodiment, the device is structured to be relatively round thereby making it suitable for use by a left-handed golf as well as a right-handed golfer. The device may also be structured to have a flat surface on one or both sides of the striking surface.

The diameter of the outer perimeter is of a width substantially equal to the diameter of a conventional golf hole.

The centerlines may be colored flat-line markings with the color being easily seen or the centerlines may be grooves cut into the tops of each vertical bar. The grooves also may, but need not be colored with a color which is easily seen.

The foregoing has outlined the more pertinent and important features of the improved putter training device in order that the detailed description that follows may be better understood so the present contributions to the art may be more fully appreciated. Additional features of the improved putter training device will be described hereinafter which form the subject of the claims. It should be appreciated by those skilled in the art that the conception and the disclosed specific embodiment may be readily utilized as a basis for modifying or designing other structures and methods for carrying out the same purposes of the improved putter training device. It also should be realized by those skilled in the art that such equivalent constructions and methods do not depart from the spirit and scope of the improved putter training device as set forth in the appended claims.

BRIEF DESCRIPTION OF THE DRAWINGS

For a fuller understanding of the nature and objects of the improved putter training device, reference should be had to the following detailed description taken in conjunction with the accompanying drawings in which:

FIG. 1 is perspective view of the preferred embodiment of the putter training device.

FIG. 2 is top plane view of another embodiment of the putter training device.

FIG. 3, as taken on line 3-3 of FIG. 1, is detailed view of the groove on the vertical bars of the putter training device.

DETAILED DESCRIPTION

Referring now to the drawings in detail and in particular to FIG. 1, reference character 10 generally designates a putter training device constructed in accordance with a preferred embodiment of the improved putter training device. An upstanding perimeter wall 12 surrounds a first vertical bar 22 and a second vertical bar 32. The upstanding perimeter wall 12 has an outer surface 17 and an inner surface 19. The first vertical bar 22 has first side 27 and a second side 29 and the second vertical bar 32 has forward section 37 and a rearward section 39.

The top 26 of the first vertical bar 22 has a centerline indicia 28 [CL-A] which is centered on the top 26 and runs the full extent of the first vertical bar 22 up to and through the outer surfaces 17 of the upstanding perimeter wall 12 at the point where they meet. Similarly the top 36 of the second vertical bar 32 has a centerline indicia 38 [CL-B] which also is centered on the top 36 and runs the full extent of the second vertical bar 32 up to and through the outer surfaces 17 of the upstanding perimeter wall 12 at the point where they meet.

The respective centerline indicias 28, 38 serve as reference lines for the golfer when using the device 10. The first vertical bar 22 and the second vertical bar 32 are substantially perpendicular to each other and define an exact center 48 at their point of intersection.

An aperture 24 is on and into the first vertical bar 22 adjacent to the second side of the first vertical bar 22. The aperture 24 is adapted to receive and retain the shaft 34 of a golf putter. The aperture 24 may be approximately midway between the centerline-B indicia and the inner surface 19 of the upstanding perimeter wall 12 or it may be more closely positioned toward the inner surface 19 of the upstanding perimeter wall 12.

The top of the upstanding perimeter wall 12 has indicia 18 on each side of the centerline-B indica 38 and may be located at a point adjacent to the forward section 37 or to the rearward section 39 of the second vertical bar 32 or adjacent to both. This indicia 18 is equally spaced from the centerline-B indicia 38 defining a distance-C [or Width-C]. It is important that Width-C be approximately equal to the width of a conventional golf ball.

With a golfer holding this device 10, the golfer would align the golfer's eyes, shoulders, and feet in parallel alignment to centerline-B indicia 38 and in substantially perpendicular alignment to centerline-A indicia 28. Using this alignment, and with centerline-B indicia 38, the golfer would execute a swing to strike the golf ball head-on as straight as possible and as exactly in between indicia 18 as possible with centerline-B indicia 38 dedicated to the center of the golf ball.

The centerlines 28, 38 on their respective vertical bars 22, 32, as well as the indicia 18 on the top of the upstanding perimeter wall 12, may be flat-line marked indicia of any color [such as black, red, green, orange, and the like] or any other suitable markings easily to be seen or, as illustrated in FIG. 3, may be cut-out or grooved surfaces 28 on the respective tops and may, but need not, also be colored. If colored, any color easily seen will suffice such as, but not limited to, black, red, green, orange, and the like.

The preferred structure of the device 10 calls for a rounded upstanding perimeter wall 12 as illustrated in FIG. 1, though a flattened front end, as illustrated in FIG. 2, is illustrative of a second embodiment of this device 10. Because of the preferred rounded structure of the upstanding perimeter wall 12, as illustrated in FIG. 1, any off-center strike, or pulling or pushing of the stroke, will result in the golf ball moving forward at a slight angle than desired or, depending on the degree off-center or pull or push, at a greater angle than desired. This provides immediate feedback to the golfer and, with repeated strokes and corrections, will aid the golfer in improving substantially the golfer's putting game.

As so structured, the device 10 attached to the shaft 34 as illustrated in FIG. 1 may be used by either a right-handed putting golfer or a left-handed putting golfer. As illustrated in FIG. 2, however, only a left-handed putting golfer could use the flat end 13 surface and only a right-handed putting golfer could use the rounded end side. It should be noted that the aperture may also be positioned closer to the first side surface 27 to accommodate a right-handed putting golfer who is intent on using the flat end surface 13 for practice. In either case, and similar to the indicia 18 as described above, the flat surface 13 bears a Width-C which is substantially same as the diameter of a conventional golf ball. The center of Width-C is at the centerline-B indicia 38.

Another important feature of the device is its width as illustrated in FIG. 2 as reference character D-D [or Width-D] and equally applies to the device 10 illustrated in FIG. 1 though not shown. Width-D, from the outer surface 17 of the upstanding perimeter wall 12 at one end to the outer surface 17 of the upstanding perimeter wall 12 at its other end is approximately the same width as the diameter of a conventional golf hole on the green. This feature, combined with the feature associated with the width of a conventional golf ball [i.e., Width-C on the device 10] adds a sense of reality and a positive psychological effect to a golfer when training with the device 10.

The present disclosure includes that contained in the present claims as well as that of the foregoing description. Although this improved putter training device has been described in its preferred forms with a certain degree of particularity, it is understood that the present disclosure of the preferred forms has been made only by way of example and numerous changes in the details of construction and combination and arrangement of parts and method steps may be resorted to without departing from the spirit and scope of the improved putter training device. Accordingly, the scope of the improved putter training device should be determined not by the embodiments illustrated, but by the appended claims and their legal equivalents.

Applicant[s] have attempted to disclose all the embodiment[s] of the improved putter training device that could be reasonably foreseen. It must be understood, however, that there may be unforeseeable insubstantial modifications to improved putter training device that remain as equivalents and thereby falling within the scope of the improved putter training device.

What is claimed is:

1. A putter training device comprising:

(a) a first vertical bar with a first side, a second side, a top with an aperture on said top adapted to receive and retain a golf shaft, and a centerline-A indicia transversing said top from said first side to said second side;

(b) a second vertical bar with a forward section, a rearward section, a top, and a centerline-B indicia transversing said top from said forward section to said rearward section wherein said second vertical bar is perpendicularly disposed to and bisecting said first vertical bar thereby defining an X-shape; and (c) an upstanding perimeter wall having an inner surface and an outer surface, said upstanding perimeter wall being around and connected at its said inner surface to said first side, to said forward section, to said second side, and to said rearward section forming a perimeter around said X-shape with a Width-D as defined by said first vertical bar and said outer surface of said upstanding perimeter wall.

2. The device of claim 1 wherein said upstanding perimeter wall has a first indicia and a second indicia on its top which are equally spaced from said centerline-B indicia and are adjacent to said forward section or to said rearward section or to both and define a Width-C from said first indicia and second indicia wherein said Width-C is an approximate width of a conventional golf ball.

3. The device of claim 1 wherein said upstanding perimeter wall has a flat surface at the forward section of said second vertical bar wherein said flat surface is approximately perpendicular to said second vertical bar and has a Width-C wherein said Width-C is an approximate width of a conventional golf ball.

4. The device of claim 1 wherein said Width-D bears an approximate width of a conventional golf hole.

5. The device of claim 1 wherein said centerline-A indicia and said centerline-B indicia comprise a groove.

6. The device of claim 1 wherein where said centerline-A indicia and said centerline-B indicia cross define an exact center-point of said upstanding perimeter wall.

7. The device of claim 1 wherein said centerline-A indicia bisects said aperture.

* * * * *